US006630802B2

(12) United States Patent
Lee et al.

(10) Patent No.: US 6,630,802 B2
(45) Date of Patent: Oct. 7, 2003

(54) COLOR CRT (CATHODE RAY TUBE) INTEGRATED WITH DEFLECTION CIRCUIT

(75) Inventors: Young-Wook Lee, Seoul (KR); Ji-Hyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/899,933

(22) Filed: Jul. 9, 2001

(65) Prior Publication Data

US 2002/0036473 A1 Mar. 28, 2002

(30) Foreign Application Priority Data

Sep. 22, 2000 (KR) ..... 2000-55619

(51) Int. Cl.[7] ..... H01J 29/02
(52) U.S. Cl. ..... 315/364; 315/399
(58) Field of Search ..... 348/809; 315/364, 315/365, 399

(56) References Cited

U.S. PATENT DOCUMENTS 3,893,174 A * 7/1975 Sano et al. ..... 348/809

5,675,426 A * 10/1997 Meisner et al. ..... 348/827

* cited by examiner

*Primary Examiner*—David Vu
(74) *Attorney, Agent, or Firm*—Fleshner & Kim, LLP

(57) ABSTRACT

Disclosed is a color CRT (Cathode Ray Tube) integrated with deflection circuit. The color CRT includes a sync signal separation and deflection circuit board attached on at least a portion of the color CRT. The sync signal separation and deflection circuit board includes a sync signal separation circuit for separating sync signal from video signal to regenerate video signal into the same contents, a horizontal deflection circuit for impressing horizontal deflection current onto a horizontal deflection coil and a vertical deflection circuit for impressing vertical deflection current onto a vertical deflection coil. The color CRT, which has the sync signal separation and deflection circuit attached on at least a portion of the color CRT, allows a one-to-one matching of the deflection circuit and a deflection yoke by removing the causes of DY fluctuation due to the change of set condition. Moreover, the color CRT reduces a manufacturing cost by mass production of the deflection circuit and the deflection yoke and facilitates improvement of quality.

14 Claims, 8 Drawing Sheets

COLOR CRT (CATHODE RAY TUBE) INTEGRATED WITH DEFLECTION CIRCUIT

BACKGROUND OF THE INVENTION

1. Field of the Invention

The present invention relates to a color CRT (Cathode Ray Tube) integrated with deflection circuit, and more particularly, to a color CRT having a deflection circuit formed integrally with the color CRT for driving a deflection yoke mounted on the color CRT by previously removing the causes of fluctuation of the deflection yoke according to the change of set conditions, without mounting on a substrate having a video signal processor of a chassis.

2. Description of the Related Art

As shown in FIG. 1, a color CRT (Cathode Ray Tube) includes a panel 16 mounted on a front surface of the CRT, a fluorescent surface 15 coated with phosphor of R (Red), G (Green) and B (Blue) colors on the inner surface of the panel, a shadow mask 14 disposed on a rear portion of the fluorescent surface and serving to select color of the electron beams incident on the fluorescent surface, a funnel 13 connected to a rear portion of the panel and maintaining the inside of the funnel in a vacuum condition, an electron gun 11 mounted in the inside of a neck part of a tube type disposed at a rear portion of the funnel for emitting the electron beams, and a deflection yoke 20 surrounding the outside of the funnel 13 and mounted for deflecting the electron beams horizontally or vertically.

The deflection yoke 20 includes a horizontal deflection coil 21, a vertical deflection coil 22, a ferrite core 23, a holder 24 and a compensating circuit board 25. As shown in FIG. 3, a compensating circuit is divided into a compensating circuit using the vertical deflection coil and a vertical deflection current and another compensating circuit using a horizontal deflection coil and a horizontal deflection current. For the compensating circuit using the vertical deflection current, there are a tilt compensating circuit, an YBH (Y-axis Bow Horizontal) compensating circuit, an YCH (Y-axis Cross Horizontal) compensating circuit, a 4 poles CY (Convergence Yoke) coil, a CCV (Corner Cross Vertical) MCM (Magnetic Current Modulation), an inner MCM (Magnetic Current Modulation), and so on. For the compensating circuit using the horizontal deflection current, there are a balance coil, a cancel coil, a CCV MCM, an inner MCM, and so on. The tilt compensating circuit has a variable resistance R16, which is connected in series between resistances R1 and R2, connected to vertical deflection coils L1 and L2. The YBH compensating circuit includes a variable resistance R7 connected in series to the vertical deflection coil, four rectifying diodes D1, D2, D3 and D4 connected in rows to the variable resistance, a compensating coil L4 connected in rows to the rectifying diode D2 and another compensating coil L5 connected in rows to the diode D1.

The YCH compensating circuit is connected in rows to resistances R10 and R13 and adjusts a variable resistance R12 by current flowing in a resistance R11. The 4 poles CY coils L6 and L7 are connected in rows to the diode D4 and the resistance R9 connected in series, to the diode D3 and a resistance R14 connected in series, and coils L4 and L5 connected in rows. The inner MCM L8 is connected in rows to a resistance R15 and connected to the 4 poles CY coils L6 and L7.

A conventional deflection yoke makes horizontal deflection currents Ih (+) and Ih (−) of a several ampere [A], which has frequency of 15.75 KHz or more, flow into the horizontal deflection coil and deflects the electron beams inside the color CRT horizontally using magnetic field generated by the horizontal deflection currents. Moreover, the conventional deflection yoke makes vertical deflection currents Iv (+) and Iv (−) of about 1[A], which has frequency of 60 Hz, flow into the vertical deflection coil and deflects the electron beams vertically using magnetic field generated by the vertical deflection currents. A self convergence type deflection yoke adjusts winding distribution of the horizontal deflection coil and the vertical deflection coil and makes barrel or pin-cushion type magnetic fields by each part (i.e., an opening part, a center part and a neck part), so that the barrel or pin-cushion type magnetic fields are converged on the same point from different distances, i.e., on a screen being a arrival place from a starting place. Because only before-mentioned deflection coil cannot satisfy laster distortion and convergence characteristics due to flatness, scale-up and high resolution of the screen, the convergence characteristics are adjusted using the convergence compensating circuit. To compensate misconvergence, such as YBH, YCH, tilt, VCR and others, occurred due to the flatness of the screen, a convergence compensating circuit 25 including a full-wave rectifying circuit, a balance coil and a CY coil using the diodes is mounted on the neck part of the deflection yoke.

Furthermore, in case that the current is flowed in the deflection coil to make the magnetic field, a ferrite core of high permeability is used to minimize a loss in a feedback path of the magnetic field, thereby increasing the magnetic field efficiency and the magnetic force. The variable resistance R16 adjusts an amount of current flowing in right and left vertical deflection coils to compensate the tilt. To compensate the inner MCM and the CCV (Corner Cross Vertical), auxiliary coils L3 and L8 for compensating the MCM are connected in series to the vertical deflection current for synchronizing the horizontal deflection current and the vertical deflection current. To compensate the YCH, the variable resistance R12 adjusts the current flowing in the auxiliary compensating coils L4 and L5, and YBH compensation amounts of 12 o'clock direction and 6 o'clock direction are adjusted. Moreover, to compensate the YBH, the variable resistance R7 is adjusted to adjust the current flowing in the auxiliary compensating coils L4 and L5. To compensate the VCR, the auxiliary compensating coils L6 and L7 are connected in series to the vertical deflection coil.

The balance coil L13 adjusts the currents of the upper and lower horizontal deflection coil, so that the screen distortion due to the linear symmetry of the horizontal deflection coil is compensated. Auxiliary coils L10 and L12 for compensating the CCV is connected to the horizontal deflection coil connected in parallel to compensate the CCV and is connected in series to the horizontal deflection coils L9 and L10 connected in parallel to compensate the inner pin-cushion.

The compensating circuits attached on the conventional deflection yoke have a restricted use only for adjusting the convergence characteristics.

Moreover, conventional color CRTs do not have the deflection circuits of oneself, differently from display devices such as LCDs or PDPs, and therefore, it is necessary to adjust the characteristics of the deflection yoke according to consumers' development styles when being manufactured. Generally, in a supply and demand condition that a yearly consumption of the color CRTs by the consumers is maximally tens of thousands and a yearly production of the color CRTs by suppliers is at least one million, the present system that must change the manufacturing conditions of suppliers according to the demand of consumers is very irrational.

The present system will be described hereinafter in more detail. A color CRT provider provides tubes, on each of which a deflection yoke is mounted, to a consumer, i.e., a set manufacturer, and the set manufacturer applies them to a new model using a chassis deflection circuit, which is old model. At this time, for impedance matching between the provided deflection yoke and the deflection circuit of the chassis, the set manufacturer requires an adjustment in characteristic of the deflection yoke to the color CRT provider. To adjust the characteristic of the deflection yoke, especially, inductance (L), the number of turns of the deflection coil must be adjusted. As a result, a mechanical dimension of the deflection coil is changed, thereby causing mislanding, i.e., purity characteristic of the color CRT. Additionally, because it is difficult to obtain the same screen characteristic if the inductance is changed, there are 10~30 kinds of the deflection yoke for one model of the color CRT, which is the same number as the set manufacturers. In this case, because a large number of deflection yokes must be manufactured for one model of the color CRT, the quality and productivity of the deflection yoke are deteriorated and the maintenance cost of the model is increased.

SUMMARY OF THE INVENTION

It is, therefore, an object of the present invention to provide a color CRT (Cathode Ray Tube) integrated with deflection circuit for allowing a one-to-one matching of the deflection circuit and a deflection yoke by attaching a sync signal separation and deflection circuit on at least a portion of the color CRT and by previously removing the causes of DY fluctuation due to the change of set condition.

It is another object of the present invention to provide a color CRT integrated with deflection circuit for allowing a reduction of manufacturing cost by mass production of the deflection circuit and the deflection yoke and improvement of quality.

To achieve the above objects, the present invention provides a color CRT (Cathode Ray Tube) integrated with deflection circuit, the color CRT, which includes an electron gun emitting three electron beams of R, G and B colors, a deflection yoke having a horizontal deflection coil and a vertical deflection coil for deflecting the electron beams to a designated place of a screen, a shadow mask for selecting colors by sorting the electron beams of the three colors, and the screen for emitting light by a collision of the electron beams onto a fluorescent surface, said color CRT comprising: a sync signal separation and deflection circuit board attached on at least a portion of the color CRT, the sync signal separation and deflection circuit board including a sync signal separation circuit for separating sync signal from video signal to represent video signal into the same contents, a horizontal deflection circuit for applying horizontal deflection current onto a horizontal deflection coil and a vertical deflection circuit for applying vertical deflection current onto a vertical deflection coil.

Preferably, the sync signal separation and deflection circuit board further includes a compensating circuit formed thereon, and the circuit board is attached on at least a portion of the color CRT.

Moreover, a portion of the sync signal separation and deflection circuit board is fixed on a funnel part of a tube, fixed and supported on the deflection yoke, disposed parallel to a longer side or a shorter side of the color CRT panel, fixed and supported on the deflection yoke and the funnel part between a high voltage applying part and the deflection yoke, or fixed and supported on a neck part and the deflection yoke or the funnel part.

According to another embodiment, the present invention provides a color CRT (Cathode Ray Tube) integrated with deflection circuit, the color CRT, which includes an electron gun emitting three electron beams of R, G and B colors, a deflection yoke having a horizontal deflection coil and a vertical deflection coil for deflecting the electron beams to a designated place of a screen, a shadow mask for selecting colors by sorting the electron beams of the three colors, and the screen for emitting light by a collision of the electron beams onto a fluorescent surface, the color CRT comprising: a deflection circuit part attached on at least a portion of the color CRT, the deflection circuit part including a horizontal deflection circuit for applying horizontal deflection current onto a horizontal deflection coil and a vertical deflection circuit for applying vertical deflection current onto a vertical deflection coil, wherein the deflection yoke and the deflection circuit part are in one-to-one impedance matching to each other before being attached on the color CRT and selected arbitrarily from mass-produced deflection yokes and deflection circuits respectively.

According to a further embodiment, the present invention provides a color CRT (Cathode Ray Tube) integrated with deflection circuit, the color CRT, which includes an electron gun emitting three electron beams of R, G and B colors, a deflection yoke having a horizontal deflection coil and a vertical deflection coil for deflecting the electron beams to a designated place of a screen, a shadow mask for selecting colors by sorting the electron beams of the three colors, and the screen for emitting light by a collision of the electron beams onto a fluorescent surface, the color CRT comprising: a deflection circuit part attached integrally with the color CRT, the deflection circuit part including: a sync signal separation circuit for separating sync signal from video signal to represent video signal into the same contents; horizontal and vertical oscillation circuits for making horizontal and vertical oscillating signals of square wave by using horizontal and vertical sync signals separated from a sync signal separating circuit or oscillation wave; a horizontal drive circuit for amplifying small output of the horizontal oscillation circuit for a horizontal output circuit for high current switching; a vertical drive circuit for improving an amplification degree and a linearity of the vertical deflection circuit and for actuating the circuit stably; a horizontal output circuit for making saw-tooth wave horizontal deflection current used for deflecting the electron beams horizontally and for making and providing high voltage pulse with a fly back transformer (high voltage generator); a vertical output circuit for making saw-tooth wave horizontal deflection current for deflecting the electron beams vertically; an AFC (Automatic Frequency Control) circuit mounted for obtaining a stable screen by detecting a phase difference between sync signal and horizontal output signal and by controlling the oscillation circuit; and an E/W (East/West) distortion compensating circuit for compensating lateral distortion of a screen pattern.

Preferably, the sync signal separation and deflection circuit board or the deflection circuit part further includes at least one of a signal impressed connection part for connecting the sync signal separation and deflection circuit board or the deflection circuit part to a high voltage circuit part mounted on a chassis and a high voltage impressed connection part for connecting the sync signal separation and deflection circuit board or the deflection circuit part to a high voltage circuit part mounted on the chassis. Alternatively, the signal impressed connection part and the high-tension circuit part may be made with an integrated connection part.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
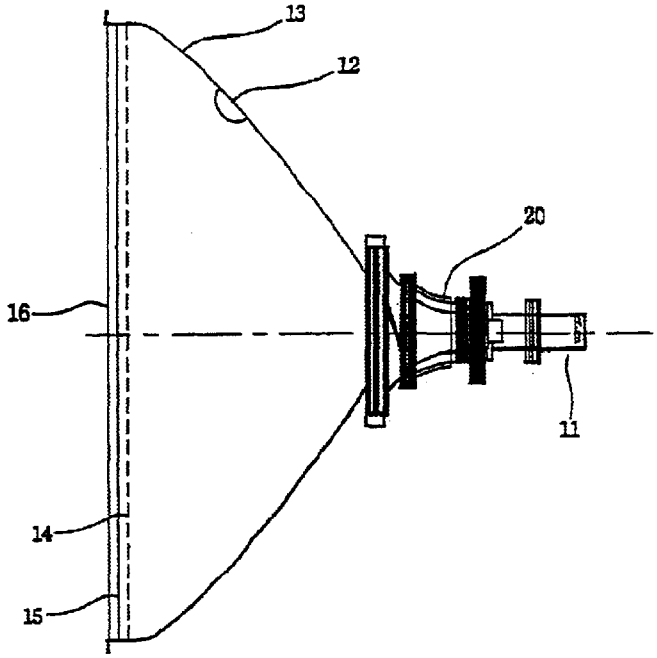
FIG. 1 RELATED ART
FIG. 1 is a schematic view of a conventional color CRT (Cathode Ray Tube)
Figure 2:
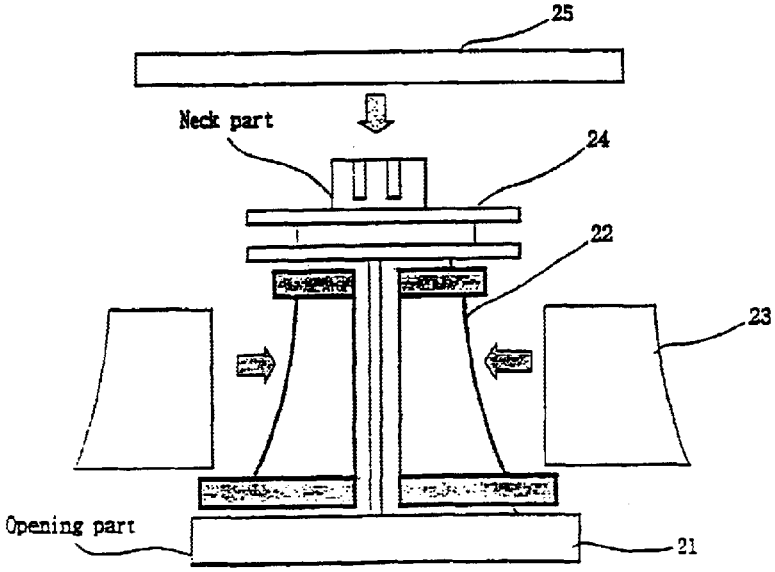
FIG. 2 is a schematic view of a deflection yoke.
Figure 3:
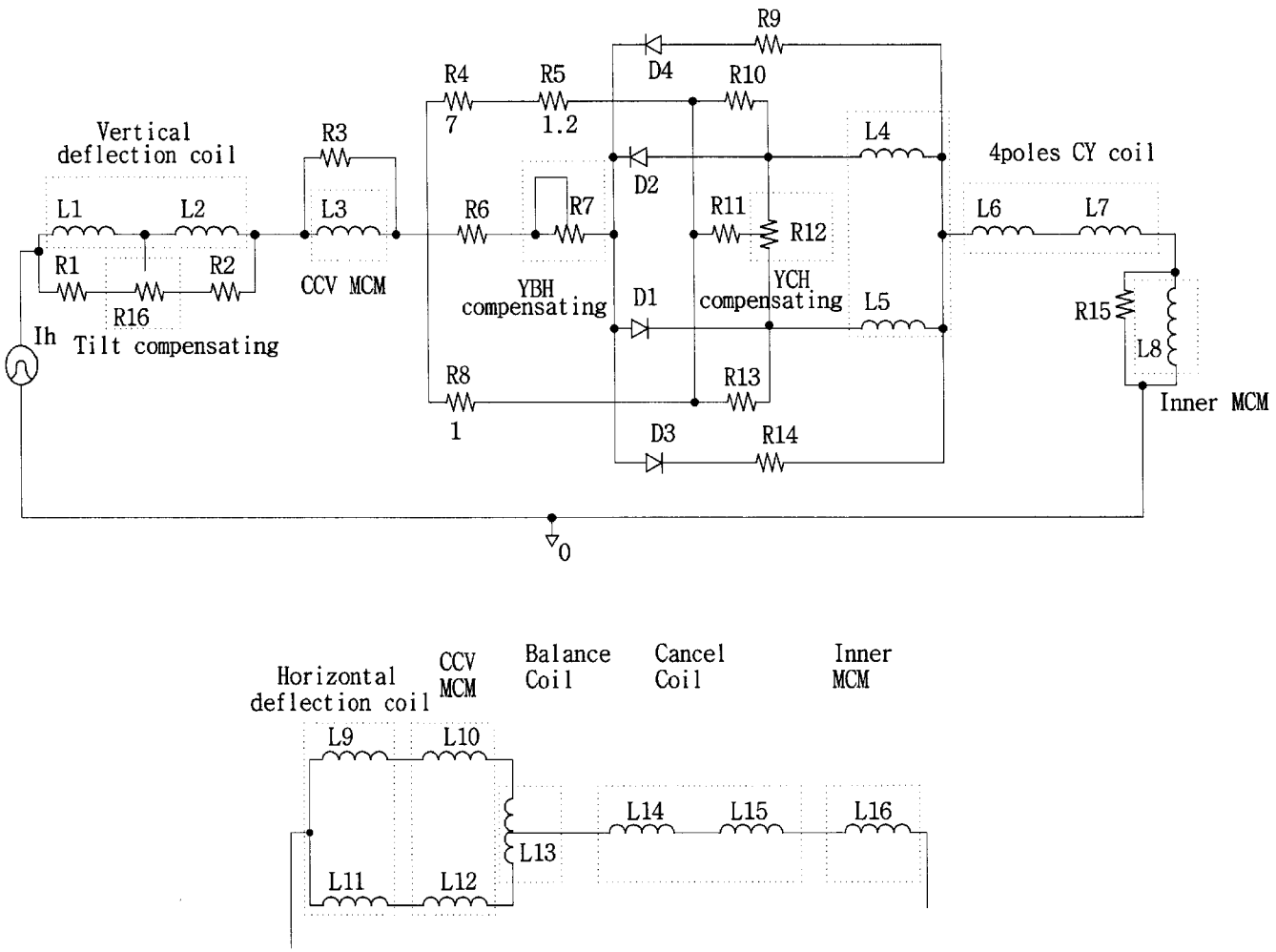
FIG. 3 is a circuit diagram of a compensating circuit.
Figure 4:
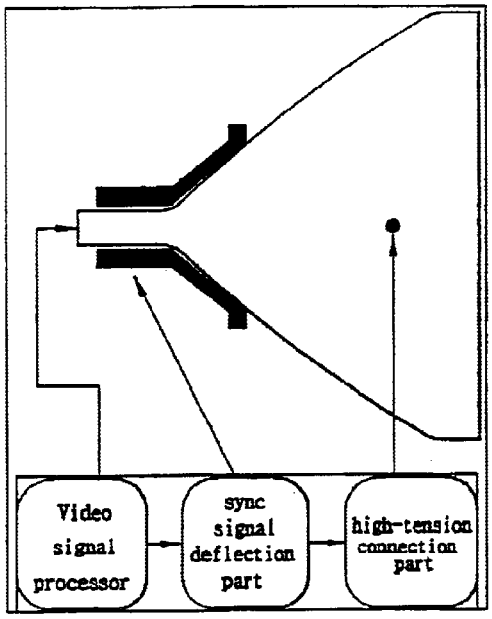
FIG. 4 RELATED ART
FIG. 4 is a view showing a structure of a conventional color television system.
Figure 5:
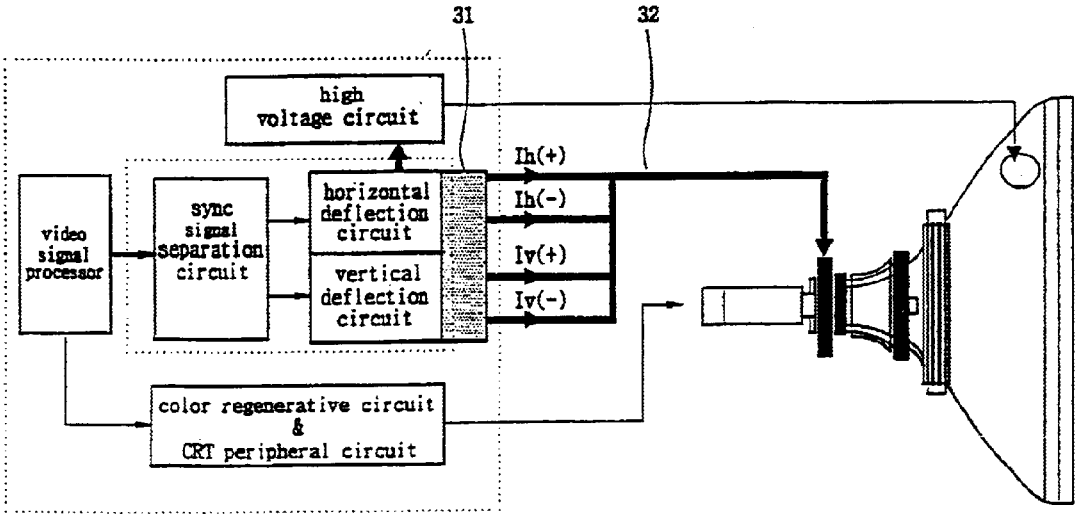
FIG. 5 RELATED ART
FIG. 5 is a wiring diagram of synchronous deflection high-tension circuit of the conventional color television system.

The present invention will now be described in detail in connection with preferred embodiments with reference to the accompanying drawings. For reference, like reference characters designate corresponding parts throughout several views.

Figure 6:
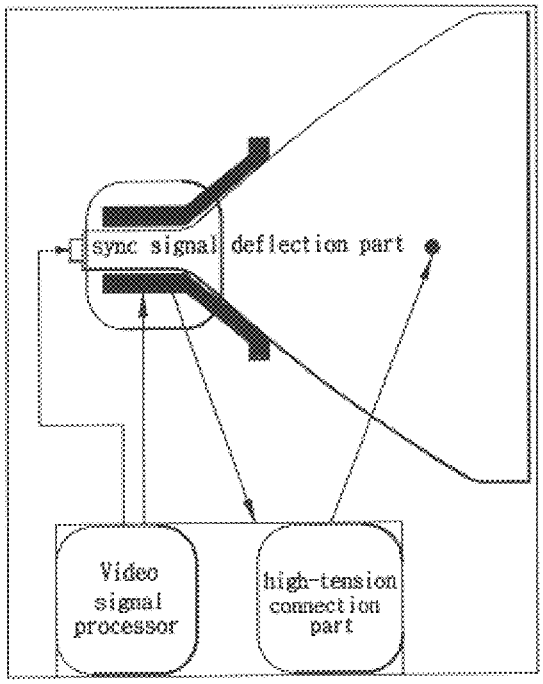
FIG. 6 is a schematic view of a color CRT integrated with deflection circuit.

FIG. 6 is a schematic view of a color CRT (Cathode Ray Tube) integrated with deflection circuit according to the present invention. In FIG. 6, a sync signal separation circuit for separating horizontal and vertical sync signals from sync signal and a deflection circuit for deflecting three electron beams of R (Red), G (Green) and B (Blue) colors horizontally and vertically are mounted on a board and the board is mounted on a deflection yoke.

Figure 7:
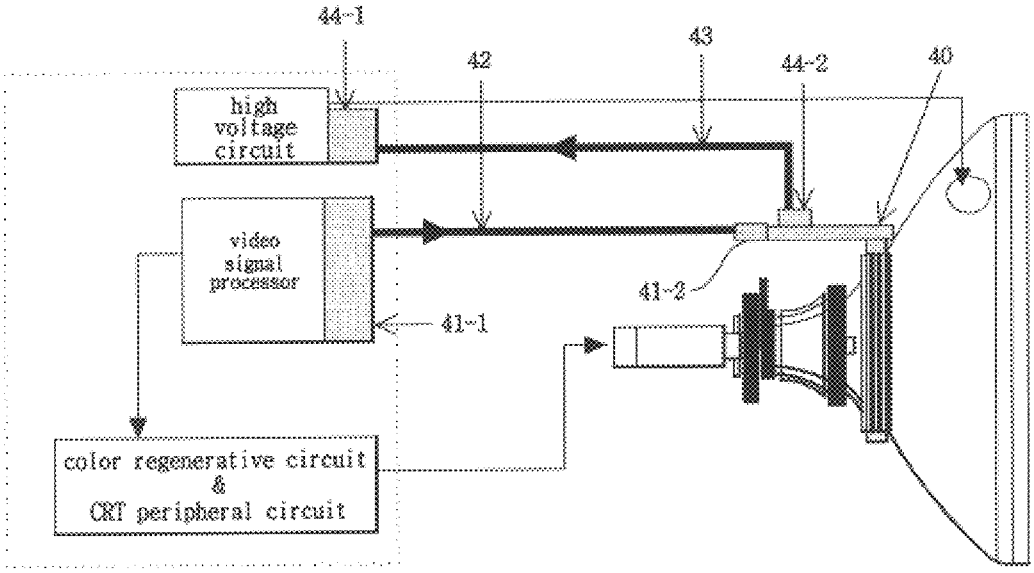
FIG. 7 is a wiring diagram of the color CRT integrated with deflection circuit.
Figure 8:
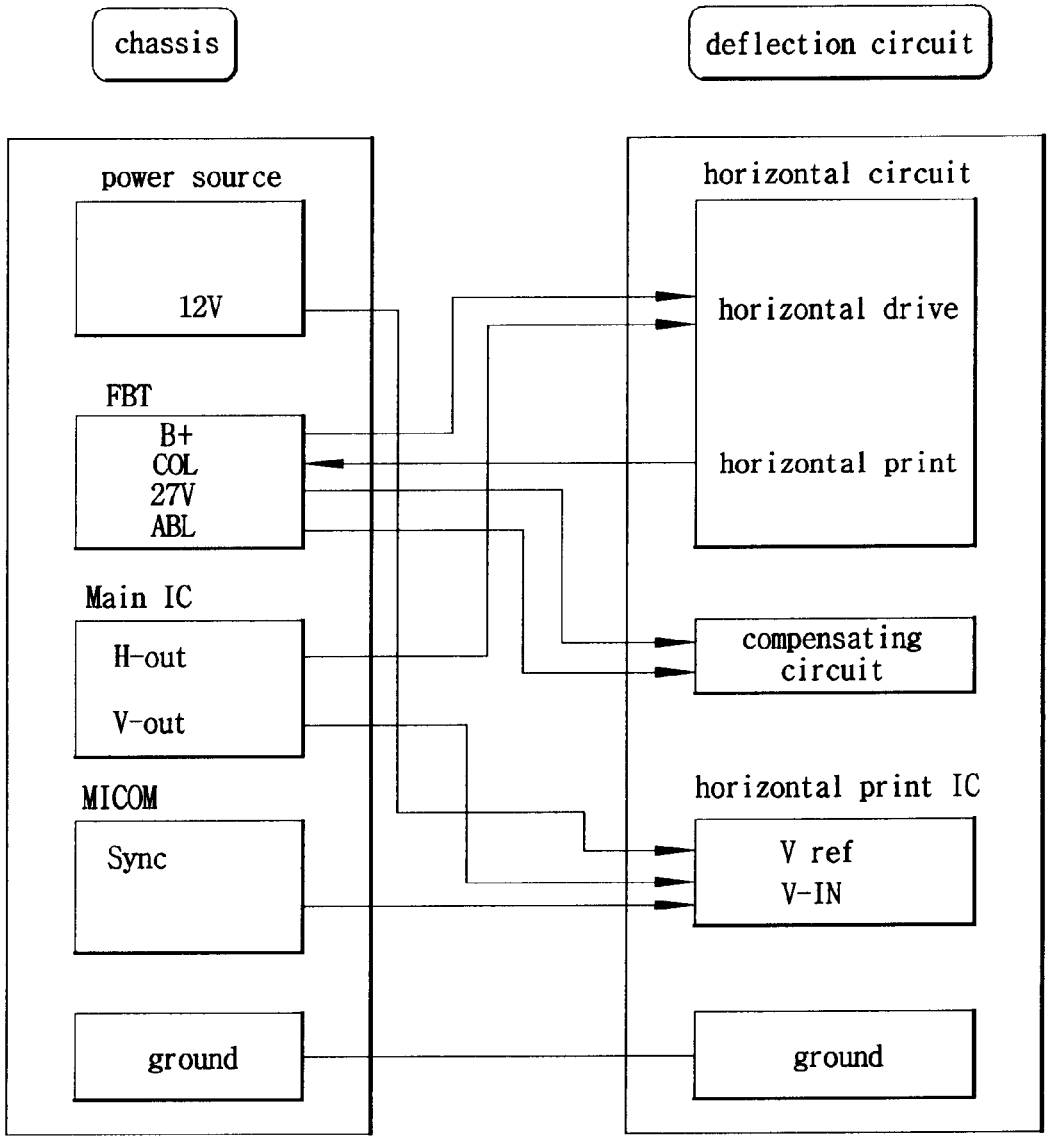
FIG. 8 is a wiring diagram of a connection lead wire between a chassis and a separated deflection circuit.
Figure 9:
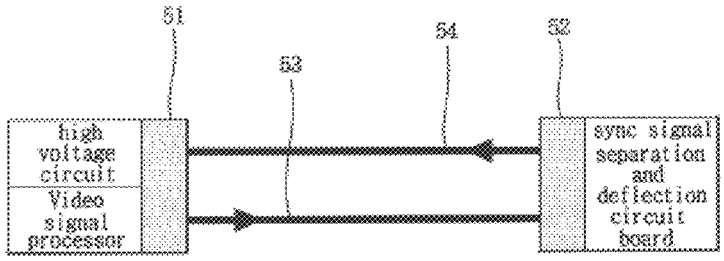
FIG. 9 is a wiring diagram using an integrated connection part.
Figure 10:
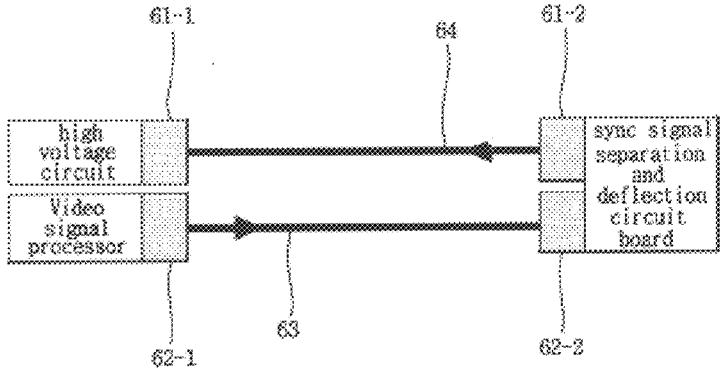
FIG. 10 is a wiring diagram using a separated connection part.

FIG. 7 is a circuit wiring view according to the present invention. In FIG. 7, a chassis includes a video signal processor, a signal supply connection part 41-1 of the video signal processor, a high voltage circuit, a high voltage supply connection part 44-1 of the high voltage circuit, a color regeneration circuit and a CRT peripheral circuit. In the color CRT, the deflection yoke includes a sync signal separation circuit and deflection circuit board, a signal supply connection part 41-2 of the sync signal separation circuit and deflection circuit board and a high voltage supply connection part 44-2 of the sync signal separation circuit and deflection circuit board on the deflection yoke. Between the chassis and the deflection yoke are a signal supply lead wire 42 and a high voltage supply lead wire 43. A wiring diagram of the supply lead wire between the chassis and the circuit board is shown in FIG. 8. Nine lead wires are needed between the chassis and the deflection circuit board. A 12V supplying part of a power source is connected to a terminal (Vref) of a vertical output integrated circuit (IC) of a deflection circuit part. B+ signal of a fly back transformer (high-tension generator) of the chassis and horizontal oscillation signal of a main IC are connected to a horizontal drive part. Pulse output of a horizontal output terminal is input into a COL (Collector) terminal of the fly back transformer of the chassis through the connection lead wire. 27V terminal of the fly back transformer and an ABL (Auto Beam Limit) terminal of the fly back transformer are input into a compensating circuit of the deflection circuit. The vertical output oscillation signal of the main IC is input into a terminal (V-IN) of the vertical output IC of the deflection circuit. Sync signal of a microcomputer (MICOM) is input into the vertical output IC of the deflection circuit. Finally, A ground of the chassis and a ground of the deflection circuit are connected to the lead wire for a common ground.

A video processing circuit takes video signal from synthetic color television signal made by receiving radio-frequency signal, obtained by an antenna input terminal, from a tuner and transmits to the CRT peripheral circuit of the color regeneration circuit. The video signal input into the CRT peripheral circuit of the color regeneration circuit is regenerated into three primary colors of R, G and B and transmitted to an electron gun. The sync signal is input into a deflection circuit board 40 mounted on the deflection yoke through the signal supply connection part 41-1 of the video signal processor, the signal supply lead wire 42 and the high voltage supply connection part 44-2 of the deflection circuit board, and then divided into vertical sync signal and horizontal sync signal by the sync signal separating circuit.

The deflection circuit is divided into the horizontal deflection circuit and the vertical deflection circuit. The horizontal deflection circuit makes the saw-tooth wave horizontal deflection currents Ih (+) and Ih (−) of a several ampere [A], which has frequency of 15.75 KHz or more, apply into a horizontal deflection coil and deflects the electron beams inside the color CRT horizontally using magnetic field generated by the horizontal deflection currents. Moreover, the vertical deflection circuit makes vertical deflection currents Iv (+) and Iv (−) of about 1 ampere [A], which has frequency of 60 Hz, apply into a vertical deflection coil and deflects the electron beams vertically using magnetic field generated by the vertical deflection currents. Moreover, pulse output of about 1,100~1,200V generated from the horizontal deflection circuit is connected to a fly back transformer of the high voltage circuit part through the high voltage supply connection part 44-2 of the sync signal separating circuit and deflection circuit board, the high voltage supply lead wire 43 and the high voltage supply connection part 44-1 of the high voltage circuit. The fly back transformer supplies voltage of about 25 kV with anode and supplies voltages required by a peripheral circuit of the CRT.

FIGS. 11 through 16 are arrangement plans of various types that the deflection circuit board 40 is attached on the color CRT according to the present invention. For signal transduction with the deflection yoke, i.e., for effectively performing the connection between the deflection circuit board 40 and the deflection circuit 20, embodiments having the optimal arrangements are shown in the drawings. Furthermore, it is important that such arrangement is made in consideration of a heat generation of the color CRT and a convenience in assembling with the chassis.

Figure 11:
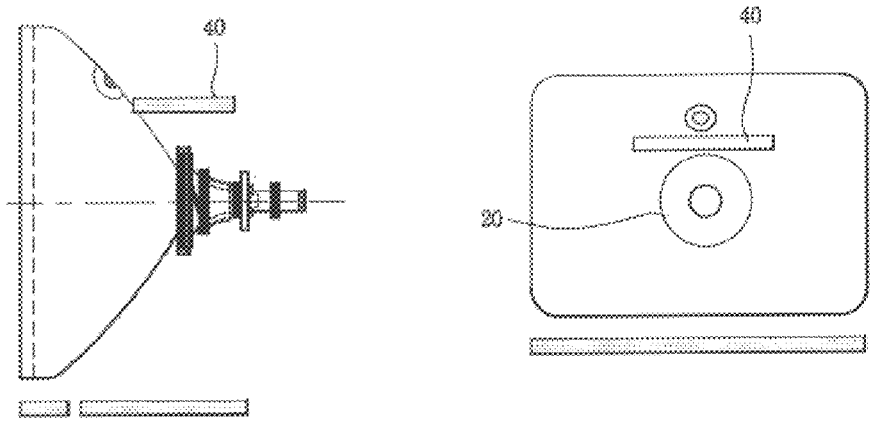
FIGS. 11 through 16 are arrangement plans of various types that a deflection circuit board is attached on the color CRT according to the present invention.
Figure 12:
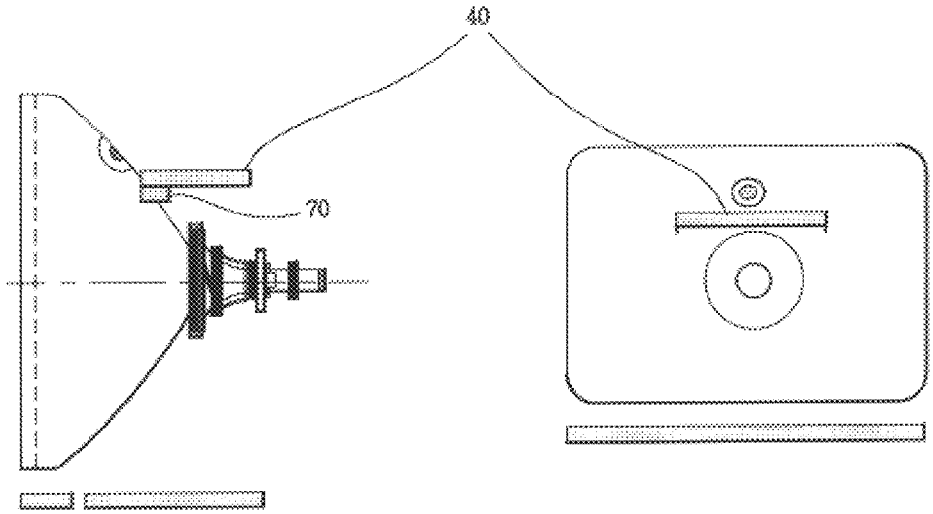

In FIG. 11, the deflection circuit board 40 is disposed vertically to a screen of the color CRT on the funnel between the deflection yoke 20 and the high voltage applying part, and is bonded by thermosetting resin bonding agent or cement. Here, because the funnel is made of glass material, an auxiliary frame 70 must be fixed on the funnel to bond the deflection circuit board 40 around the funnel, as shown in FIG. 12.

Figure 13:
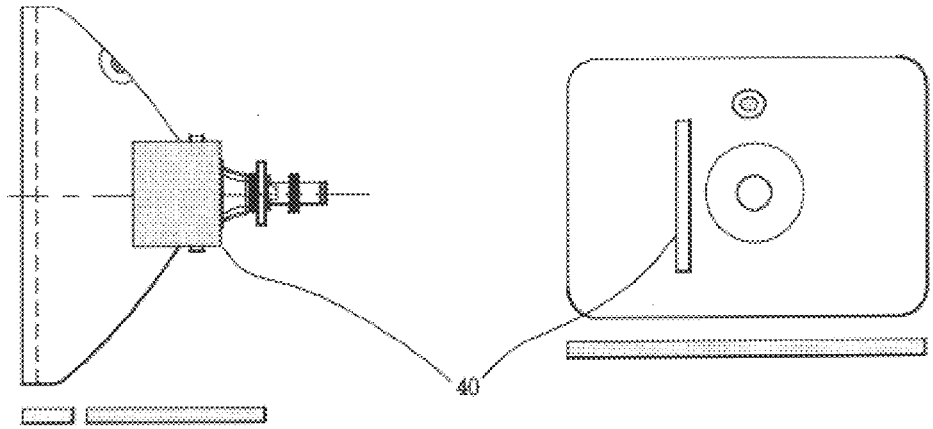

FIG. 13 is a view of the deflection circuit board 40 disposed parallel to a side of the screen. The auxiliary frame 70 may be used as shown in FIG. 12 and the deflection circuit board 40 may be disposed at an opposite position of the deflection circuit board of FIGS. 11 and 12.

Figure 14:
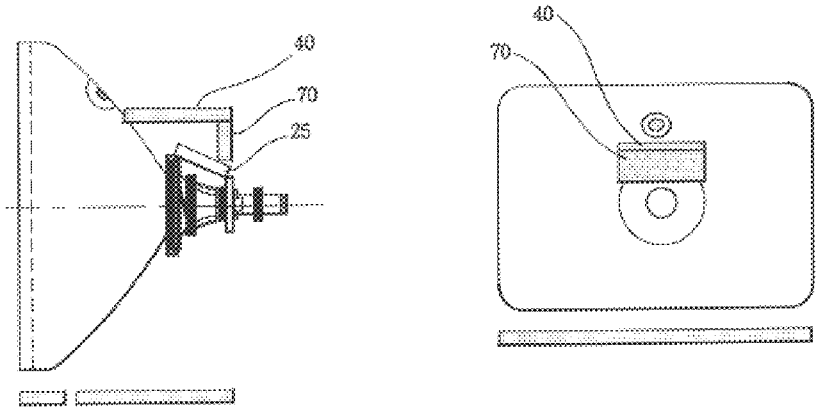

FIG. 14 shows the deflection circuit board 40 separated from a compensating circuit 25. The deflection circuit board 40 is fixed and supported on the auxiliary frame 70 attached on the compensating circuit. In a case of an integrated deflection circuit board 40 and compensating circuit 25, it may be disposed on the deflection yoke like the disposition of the compensating circuit.

Figure 15:
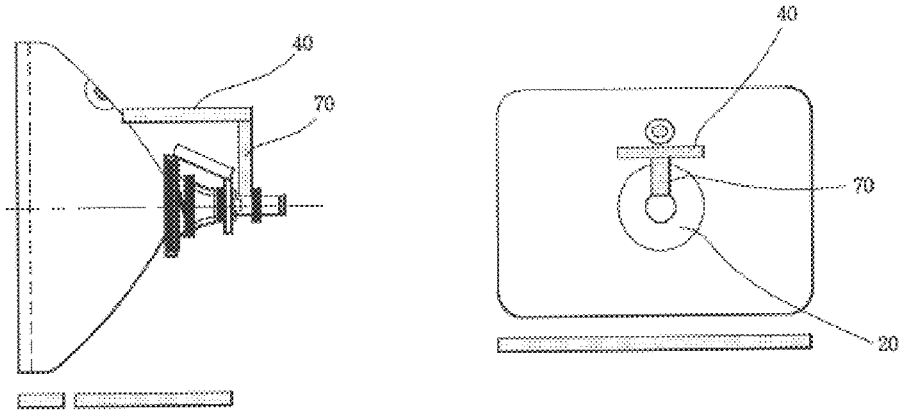
Figure 16:
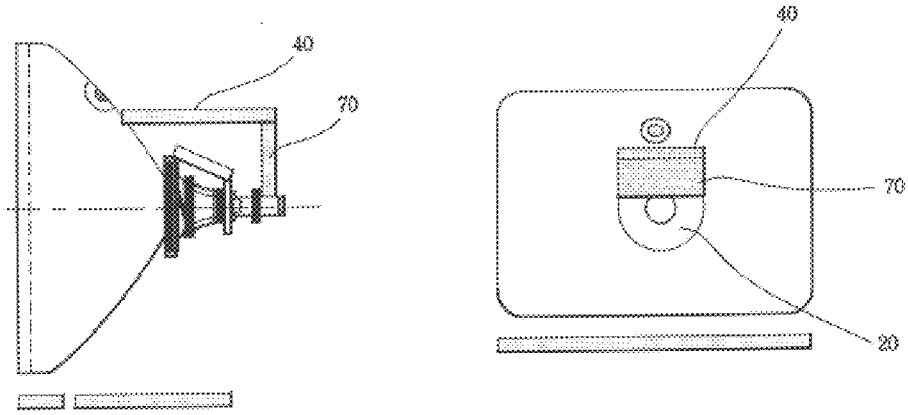

FIGS. 15 and 16 shows a state that the auxiliary frame 70 is fixed on the neck part. The width of the auxiliary frame 70 can be adjusted to be wide or narrow according to the width of the neck part, so that the auxiliary frame 70 has the same width as the deflection circuit board.

As described above, the disposition of the deflection circuit board 40 can be varied without departing from the scope of the present invention.

Therefore, according to the present invention, when the sync signal separation and deflection circuit is attached on the deflection yoke and provided to a set manufacturer, the set maker and a CRT maker who manufactures the color CRT and the deflection yoke can obtain the following effects.

First, because the tube and the deflection yoke in a module tube are in one-to-one model matching, the CRT maker who manufactures the tube and the deflection yoke can obtain improvement of quality and maximization of productivity through the mass production of a single kind of tube and a reduction of maintenance cost by maintaining the various kinds of deflection yokes for single model tube.

Second, the optimum design of the deflection circuit can reduce a material cost of the deflection circuit. If an ASIC (Application Specific IC) of the deflection circuit components is realized, it reduces the material cost, compared with the deflection circuit part embodied with analog circuit components. Because the CRT maker can produce the tubes of millions in large scale yearly, compared with the when that the set maker did buy the deflection circuits of a several ten thousands, total set manufacturing cost can be reduced by the reduction of component costs.

Third, because the CRT maker develops the deflection circuit, the set maker can develops only the circuits such as a video signal processing part, a high voltage circuit part and others. As a result, in case of the set maker, the number of workers for developing the deflection circuit is reduced, a burden of maintenance of the deflection circuit is reduced and a period of time required for the set development is also reduced. In general, if the deflection yoke is provided to the set maker, the set maker checks impedance of the deflection circuit and of the deflection yoke of new model and returns to the CRT maker (deflection yoke manufacturer) for requiring the change of deflection yoke manufacturing conditions such as adjustment of impedance value. The period of time from the provision of the deflection yoke to the feedback requiring the change of the deflection yoke manufacturing conditions is about three weeks. However, if the module tube according to the present invention is applied, the period of time required for the impedance matching can be reduced up to about 12.5% of the period of time required for the set development.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A color CRT (Cathode Ray Tube) integrated with deflection circuit, the color CRT, which includes an electron gun emitting three electron beams of R, G and B colors, a deflection yoke having a horizontal deflection coil and a vertical deflection coil for deflecting said electron beams to a designated place of a screen, a shadow mask for selecting colors by sorting said electron beams of the three colors, and the screen for emitting light by a collision of said electron beams onto a fluorescent surface, the color CRT comprising:

a sync signal separation and deflection circuit board attached on at least a portion of said color CRT, the sync signal separation and deflection circuit board including a sync signal separation circuit for separating sync signal from video signal to represent video signal into the same contents, a horizontal deflection circuit for applying horizontal deflection current onto a horizontal deflection coil and a vertical deflection circuit for applying vertical deflection current onto a vertical deflection coil.

2. The color CRT as claimed in claim 1, wherein said sync signal separation and deflection circuit board further includes a compensating circuit formed thereon, and said circuit board is attached on at least a portion of the color CRT.

3. The color CRT as claimed in claim 2, wherein the compensating circuit is at least one of a compensating circuit for compensating E/W distortion and a compensating circuit for compensating characteristics of deflection yoke.

4. The color CRT as claimed in claim 1, wherein a portion of the sync signal separation and deflection circuit board is fixed on a funnel part of a tube by an adhesive.

5. The color CRT as claimed in claim 4, wherein said sync signal separation and deflection circuit board is disposed parallel to a longer side or a shorter side of the color CRT panel.

6. The color CRT as claimed in claim 1, wherein said sync signal separation and deflection circuit board is fixed and supported on the deflection yoke.

7. The color CRT as claimed in claim 1, wherein said sync signal separation and deflection circuit board is fixed and supported on the deflection yoke and the funnel part between a high voltage applying part and the deflection yoke.

8. The color CRT as claimed in claim 1, wherein said sync signal separation and deflection circuit board is fixed and supported on a neck part and the deflection yoke or the funnel part.

9. A color CRT (Cathode Ray Tube) integrated with deflection circuit, the color CRT, which includes an electron gun emitting three electron beams of R, G and B colors, a deflection yoke having a horizontal deflection coil and a vertical deflection coil for deflecting the electron beams to a designated place of a screen, a shadow mask for selecting colors by sorting the electron beams of the three colors, and the screen for emitting light by a collision of the electron beams onto a fluorescent surface, the color CRT comprising:

a deflection circuit part attached on at least a portion of the color CRT, the deflection circuit part including a horizontal deflection circuit for applying horizontal deflection current onto a horizontal deflection coil and a vertical deflection circuit for applying vertical deflection current onto a vertical deflection coil, wherein said deflection yoke and said deflection circuit part are selected arbitrarily from mass-produced deflection yokes and deflection circuits respectively in one-to-one impedance matching to each other before being attached on the color CRT.

10. A color CRT (Cathode Ray Tube) integrated with deflection circuit part, the color CRT, which includes an electron gun emitting three electron beams of R, G and B colors, a deflection yoke having a horizontal deflection coil and a vertical deflection coil for deflecting the electron beams to a designated place of a screen, a shadow mask for selecting colors by sorting the electron beams of the three colors, and the screen for emitting light by a collision of the electron beams onto a fluorescent surface, said deflection circuit part comprising:

a sync signal separation circuit for separating sync signal from video signal to represent video signal into the same contents;

horizontal and vertical oscillation circuits for making horizontal and vertical oscillating signals of square wave by using horizontal and vertical sync signals separated from a sync signal separating circuit or oscillation wave;

a horizontal drive circuit for amplifying small output of the horizontal oscillation circuit for a horizontal output circuit for high-current switching;

a vertical drive circuit for improving an amplification degree and a linearity of the vertical deflection circuit and for actuating the circuit stably;

a horizontal output circuit for making saw-tooth horizontal deflection current used for deflecting the electron beams horizontally and for making and providing high voltage pulse with a fly back transformer (high voltage generator);

a vertical output circuit for making saw-tooth horizontal deflection current for deflecting the electron beams vertically; and an AFC (Automatic Frequency Control) circuit mounted for obtaining a stable screen by detecting a phase difference between sync signal and horizontal output signal and by controlling the oscillation circuit.

11. The color CRT as claimed in claim 1, wherein the sync signal separation and deflection circuit board or the deflection circuit part further includes at least one of a signal supply connection part for connecting the sync signal separation and deflection circuit board or the deflection circuit part to a high voltage circuit part mounted on a chassis and a high voltage supply connection part for connecting the sync signal separation and deflection circuit board or the deflection circuit part to a high voltage circuit part mounted on the chassis.

12. The color CRT as claimed in claim 11, wherein said signal supply connection part and the high voltage supply connection part are made with an integrated connection part.

13. The color CRT as claimed in claim 1, wherein said sync signal separation and deflection circuit board is fixed and supported by an auxiliary frame supported on at least one of the funnel, the deflection yoke and the neck part.

14. The color CRT as claimed in claim 9, wherein said sync signal separation and deflection circuit board includes at least one of a compensating circuit for compensating E/W distortion and a compensating circuit for compensating characteristics of deflection yoke.

* * * * *